US005776083A

United States Patent [19]

Jacob et al.

[11] Patent Number: 5,776,083

[45] Date of Patent: Jul. 7, 1998

[54] EXERCISE DEVICE FOR USE IN THE REHABILITATIVE THERAPY OF JOINT COMPLEXES

[76] Inventors: Gary Jacob, 678 Swarthmore, Pacific Palisades, Calif. 90272; Charles J. Aplin, III, 29230 Deep Shadow Dr., Agoura Hills, Calif. 91301

[21] Appl. No.: 343,350

[22] Filed: Nov. 22, 1994

[51] Int. Cl.[6] ..... A61H 1/00

[52] U.S. Cl. ..... 601/23; 601/33; 482/131; 482/907

[58] Field of Search ..... 482/44, 91, 92, 482/105, 106, 109, 131, 139, 148, 907; 273/193 A; 601/33; 135/65, 70

[56] References Cited

U.S. PATENT DOCUMENTS

| | | | |
|---|---|---|---|
| D. 209,759 | 1/1968 | Snyder . | |
| 1,714,391 | 5/1929 | McWhirter . | |
| 2,642,074 | 6/1953 | Pedley et al. | 135/65 |
| 3,228,683 | 1/1966 | Leteff . | |
| 3,820,781 | 6/1974 | Kane . | |
| 3,942,790 | 3/1976 | Rice . | |
| 4,274,430 | 6/1981 | Schaaf et al. | 135/65 |
| 4,395,039 | 7/1983 | Kaiser . | |
| 4,565,367 | 1/1986 | Kaiser | 482/131 |
| 4,641,836 | 2/1987 | Clifton | 482/109 |
| 4,746,806 | 5/1988 | Campagnuolo | 482/92 |
| 4,770,414 | 9/1988 | Fredrickson et al. . | |
| 5,052,681 | 10/1991 | Williams | 482/44 |

FOREIGN PATENT DOCUMENTS

| | | | |
|---|---|---|---|
| 1258442 | 9/1986 | U.S.S.R. | 482/44 |
| 2229934 | 10/1990 | United Kingdom | 482/44 |

*Primary Examiner*—Lynne A. Reichard
*Assistant Examiner*—Jeanne M Clark
*Attorney, Agent, or Firm*—Blakely,Sokoloff,Taylor & Zafman

[57] ABSTRACT

The present invention provides an exercise bar for use in rehabilitative therapy of joint structures, especially those of an impaired limb of a user. The exercise bar preferably comprises an elongated shaft having a longitudinal axis and two ends, a loop member comprising a loop attached to a first end of the shaft, and a handle member attached to a second end of the shaft at an angle to both the longitudinal axis of the shaft and the plane defined by the loop of the loop member. The loop preferably is in the shape of an isosceles triangle with the angles forming arcuated notches for receiving a portion of the user's impaired limb. Once the user's limb is seated within one of the notches, the shaft may be rotated about it axis to enable rotational, resistive stretching of a first joint complex or may be reciprocated along its axis to enable the performance of various exercises.

4 Claims, 7 Drawing Sheets

EXERCISE DEVICE FOR USE IN THE REHABILITATIVE THERAPY OF JOINT COMPLEXES

BACKGROUND OF THE INVENTION

1. Field of the Invention

The present invention is related to the field of exercise devices, and more specifically to exercise bars used in the rehabilitation of joint structures.

2. Description of Related Art

When the muscles, tendons, discs, menisci, bursae, ligaments and/or joint capsules, hereinafter sometimes referred to as elements of a joint complex have been damaged or otherwise compromised due to disuse, injury or a surgical procedure, rehabilitation of the joint complex through stretching of the damaged area may be prescribed to ensure full recovery of the complex. These exercises typically consist of stretches designed to increase the elasticity of the shortened elements of the joint complexes. In the past, the exercises were primarily performed without the aid of instruments or machines designed to assist in stretching the shortened elements. However, in many instances, unaided exercises have been found to be therapeutically inadequate, in part, because the involved elements were not moved to the end of the range of movement.

Accordingly, physical medicine specialists have developed a wide variety of exercise devices to resolve this problem, these devices being designed to aid the user typically through the use of counter-balancing structures that can be manipulated by one or more limbs to better stretch the shortened elements of the joint complex.

For example, U.S. Design Pat. No. 209,759 issued to Snyder discloses an exerciser having an elongated shaft with two gripping handles disposed perpendicular to the shaft at one end and two foot braces disposed perpendicular to the shaft at the other end. This device is apparently used to resistibly exercise or stretch the muscles about the shoulders, elbows, thighs and knees when the user pulls up on the handle grips with the arms and pushes down on the foot braces with the legs.

Furthermore, U.S. Pat. No. 3,228,683 issued to Leteff discloses an exercise device in the form of an upstanding "T" having a crossbar rotatably attached to a stationary, elongated shaft to permit rotation of the user's trunk in exercising the hip muscles.

U.S. Pat. Nos. 3,820,781 and 4,770,414 issued to Kane and Fredrickson et al., respectively, both disclose an exercise device comprising a bar to be placed across the user's shoulders to permit twisting and bending exercises about the waist. In the Kane reference, a yoke-shaped arc is provided to fit around the user's neck, while in the Fredrickson et al. reference, angled handle grips are provided at the ends of the bar to make the arms of the user more comfortable.

When in addition to a compromised joint complex, a patient also has an impaired limb, such as an impaired hand, specially designed exercise devices having simple means for manipulating the device are required to enable proper therapy. For example, U.S. Pat. No. 4,395,039 issued to Kaiser discloses a method for rehabilitation of arm and shoulder injuries using a rigid, elongated shaft having a gripping member attached to one end of the shaft via an elastic cord. The gripping member and elastic cord combination allows a user to easily grasp the member with the hand of an impaired limb and flexibly reciprocate the limb by moving the elongated shaft back and forth. Alternatively, U.S. Pat. No. 3,942,790 issued to Rice discloses a Teflon exercising device comprising an elongated bar having either a ball on each end or a suction cup attached to one end to enable a patient having an impaired hand to perform various exercises using either one or both hands. Similarly, U.S. Pat. No. 1,714,391 issued to McWhirter discloses an extensible exercise bar having large spheres attached to each end, the device being collapsible to the proper length to permit the user to perform a variety of exercises.

Nonetheless, the devices described above provide only limited utility in terms of the types or variety of therapeutic exercises that can be performed by individuals having impaired limbs, and especially, grip impaired hands.

Although the devices described immediately above permit exercising of the shortened elements disposed about joint complexes of an impaired limb, they have the disadvantages of 1) limiting the number of exercises for joint complexes and types of movements possible, and 2) requiring the user's hands to be sufficiently adept and agile to manipulate the spheres or handle grips of the devices.

Accordingly, it would be advantageous to provide a an exercise device designed to assist a patient in exercising mutliple joint complexes in multiple directions in passive, active assisted and/or active resistance, especially with an impaired limb or a grip-impaired hand. Resisted exercise may include isometric, isotonic eccentric and isotonic concentric exercise.

SUMMARY OF THE INVENTION

It is therefore an object of the present invention to provide an exercise device suitable for use in rehabilitative therapy of the shortened elements of a joint complexes, and especially, for use in the performance of passive and active exercises by a user having an impaired limb or impaired grip.

It is another object of the present invention to provide an exercise device comprising an elongated tubular bar having a hook disposed at one end and a loop disposed at the other end in-line with the longitudinal axis of the bar for the rehabilitative passive and active exercising of the elements of a joint complexes.

It is yet another object of the present invention to utilize the exercise device set forth above in performing special exercises wherein a grip impaired limb is inserted within the loop for assisted exercise in any of a plurality of directions by leveraging the opposite end of the device with the unimpaired limb.

These and other objectives are accomplished by providing an exercise bar which preferably comprises an elongated shaft having a longitudinal axis with a first and second end, a loop member comprising a loop attached to a first end of the shaft, and a handle member attached to a second end of the shaft at an angle to both the longitudinal axis of the shaft and the plane defined by the loop of the loop member. The loop preferably comprises the shape of an isosceles triangle with the angles forming arcuated notches for receiving a portion of the user's impaired limb.

Once the user's limb is seated within one of the arcuate notches, the shaft may be rotated about it axis or may be reciprocated along its axis. Additionally, for rotational exercises, the seated portion of the impaired limb is secured within the loop member by clenching the seated portion between the notches of the loop along one of the straight legs of the triangularly shaped member. Rotation of the shaft about its longitudinal axis then causes rotation of the limb, and consequently stretching of the shortened elements of the joint complex. For the other exercises, a second joint complex is seated within a notch of the loop member, and the shaft is reciprocated along its longitudinal axis as may be required for rehabilitation of the impaired limb of the first joint complex.

BRIEF DESCRIPTION OF THE DRAWINGS

The objects, features and advantages of the present invention will be apparent from the following detailed description in which:

FIG. 2(*a*) & 2(*b*): Shoulder Abduction (standing or horizontal)

FIG. 3: Shoulder Flexion

FIG. 4: Shoulder Abduction

FIG. 5(*a*) & 5(*b*): Horizontal Abduction

FIG. 6: Assisted Shoulder Flexion—Shoulder Flexion—Modified

FIG. 7: Bilateral Shoulder Flexion

FIG. 8: Bilateral Shoulder Extension

FIG. 9: Shoulder Extension (one arm)

FIGS. 10(*a*) & 10(*b*): Shoulder Internal Rotation—Neutral Position 0°

FIG. 11: Shoulder Internal Rotation @90° Abduction

FIG. 12: Bilateral Shoulder Internal Rotation—Bilateral Elbow Flexion

FIG. 13: Shoulder Internal Rotation—Abduction; Behind the Back Elbow Flexion FIG. 14: Shoulder External Rotation—Neutral Position 0°

FIG. 15: Shoulder External Rotation—W/ Loss of Grip on Involved Side

FIG. 16: Shoulder External Rotation—90° Abduction

FIGS. 17(*a*), 17(*b*) & 17(*c*): Shoulder External Rotation—90° Abduction—Aplin Maneuver FIGS. 18(*a*) & 18(*b*): Shoulder External Rotation—Jacob Maneuver FIG. 19: Shoulder External Rotation—Abduction FIGS. 20(*a*) & 20(*b*): Elbow Flexion FIGS. 21(*a*) & 21(*b*): Elbow Extension FIG. 22: Wrist Flexion FIG. 23: Wrist Extension FIGS. 24(*a*), 24(*b*) & 24(*c*): Forearm Pronation/Supination FIG. 25(*a*) & 25(*b*): Wrist Ulnar/Radial Deviation FIG. 26: Knee Extension (seated)

FIG. 27: Knee Extension (lying)

FIG. 28: Hip Flexion Hamstring Stretch

FIG. 29: Hip Extension—Knee Flexion—Ankle Plantar Flexion (lying)

FIG. 30: Hip Extension—Knee Flexion—Ankle Plantar Flexion (standing)

FIG. 31: Hip External Rotation—Abduction (sitting)

FIG. 32: Hip Internal Rotation (sitting)

FIG. 33: Low Back Extension

FIG. 34: Cervical Retraction and Extension

FIG. 35(*a*) & 35(*b*): Ankle and Mid-Tarsal Dorsi Flexion (seated)

FIG. 36(*a*) & 36(*b*): Ankle and Mid-Tarsal Plantar Flexion (seated)

FIG. 37(*a*) & 37(*b*): Ankle Inversion (seated)

FIG. 38(*a*) & 38(*b*): Ankle Eversion (seated)

DETAILED DESCRIPTION OF THE INVENTION

The present invention provides an exercise device for use in rehabilitative therapy of joint structures, especially those of an impaired limb or impaired grip.

In the following description, for purposes of explanation and not limitation, specific details are set forth, such as preferred structures, particular dimensions, specific exercises, etc. in order to provide a thorough understanding of the present invention. However, it will be apparent to one skilled in the art that the present invention may be practiced in other embodiments and without all the specific details set forth. In other instances, well known features and uses are not set forth in detail in order to avoid unnecessarily obscuring the present invention.

Figure 1:
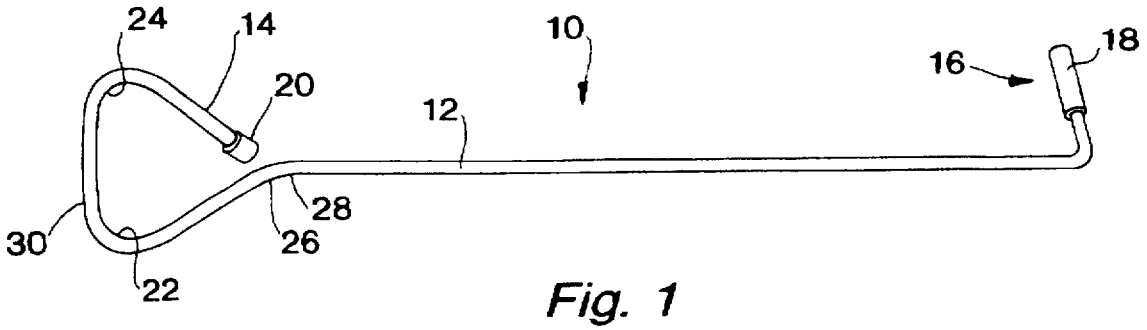
FIG. 1 depicts the structural characteristics of the preferred embodiment of the exercise bar.

As shown in FIG. 1, the exercise device 10 of the present invention forms an exercise bar having an elongated shaft 12 with a loop member 14 disposed at a first end and a hook member 16 disposed at a second end. The loop member is designed to receive and loosely secure an impaired limb of a user to the end of the shaft to provide assistance in moving the limb in the performance of exercises. A pad 18 is disposed over the hook member 16 and a rubber cap 20 is disposed at the end of the device within the loop member 14.

The loop member has one or more arcuate angles or notches 22 and 24 formed therein in which the impaired limb of a user can be retained during manipulation of the device. Once a distal end of a limb is seated within a notch, the limb can be moved in a plurality of directions to perform a multitude of exercises described in more detail below. Additionally, the limb can be moved to provide either passive or active resistance exercise by rotating the handle of the device about the longitudinal axis of the shaft.

To secure the limb within the loop member, the loop member preferably comprises a triangular shape. In the preferred embodiment, the triangular loop member forms an isosceles triangle having a vertex 26 coupled to the end 28 of the shaft and a linear base 30 disposed opposite therefrom.

With this arrangement, the vertex of the loop member will also provide assistance in securing the distal end of the impaired limb during various exercises by seating a joint complex therein. For example, to flex an elbow joint or knee joint, the corresponding wrist joint or ankle joint is seated within the vertex of the loop during movement of the device in the required direction or directions. Accordingly, the loop can be advantageously used to secure the limb within the device during movement to enable a wide variety of exercises.

Notwithstanding the preferred shape of the loop as a triangle, other loop shapes, such as circular, rectangular and multiple loop structures may be used without departing from the spirit of the present invention.

To best enable manipulation of the device by the unimpaired limb of the user, the handle member of the device preferably forms an elongated hook-like structure disposed perpendicular to the longitudinal axis of the shaft. To provide the most torque on the secured portion of the impaired limb, the handle member is also preferably disposed perpendicular to the plane defined by the loop member, which plane is further in line with and bisected by the longitudinal axis of the shaft. Nonetheless, it is foreseeable that the handle member may be disposed at a plurality of angles with respect to the shaft and the loop member, and may even further comprise a large gripping member or sphere easily manipulable by a hand.

In terms of the device's construction, the entire device is preferably made from a lightweight and cost effective material such as aluminum or plastic, but may otherwise be made from any rigid and sturdy material such as steel, wood and the like. In manufacture, the device can either be molded in its final shape or extruded as a single elongated piece and then shaped. The over-all length of the device in the preferred embodiment is approximately three feet, while the handle member extends approximately six inches and the sides of the isosceles-shaped loop member are approximately five inches in length.

For users or therapy patients with impaired limbs, the device of the present invention is particularly well suited for performing both active and resistive flexion, rotation, abduction, adduction, extension, supination, pronation, ulnar or radial deviation, inversion, eversion, retraction, foot dorsiflexion, foot plantiflexion and any other available passive or active exercises in recuperation of the impaired limb. This results from the fact that the functional design of the device not only enables coupling of the movement of the unimpaired limb with the impaired limb, but advantageously provides a simple means for loosely securing the distal portion of the user's limb during the performance of the exercises so that the limb can be fully extended throughout its range for optimum recovery. In example of the variety of exercises that can be performed, a plurality of exercises specifically designed for the device of the present invention are shown in FIGS. 2–38 which are described below. It will be understood by persons of skill in the art that while the present invention is described primarily with reference to stretching exercises, various resistance exercises can be performed as well. For isometric exercises in combination with stretching exercises, once the end point of the stretch is performed, isometric resistance can be applied, after which a further stretch can be pursued. Alternatively, if the impaired limb resists in the stretching direction, isotonic resistance exercises can be performed.

Figure 2A:
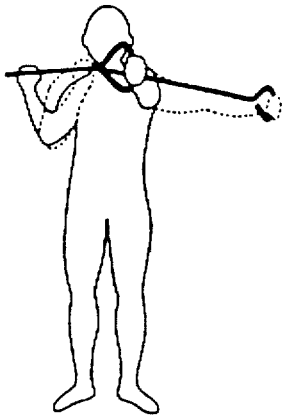
FIGS. 2–38 depict the various exercises specially designed for use with the exercise bar of the present invention in the performance of flexion, supination, pronation, ulnar and radial deviation, inversion, eversion, retraction, foot dorsiflexion, foot plantiflexion, rotational, abduction, adduction and extension exercises, wherein the figures represent the following exercises.
Figure 2B:
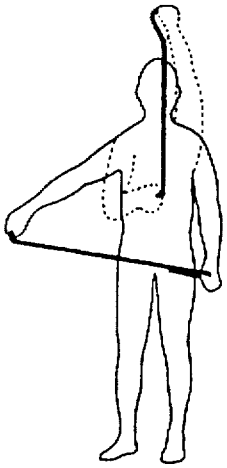

FIG. 2: Shoulder Abduction (standing or horizontal)

Horizontal: Use the hand of the involved side to hold the exercise bar directly in front of the body at shoulder level. Grasp the hook with the hand of the uninvolved side. (FIG. 2(*a*)) The hand of the uninvolved side pushes the exercise bar toward the involved side moving it outward.

Overhead: Use the hand of the involved side to hold the triangle. Hold the hook with the hand of the uninvolved side. (FIG. 2(*b*)). Push on the hook toward the side of the body to bring the arm out and up (abduction).

Figure 3:
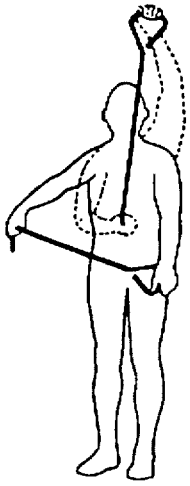

FIG. 3: Shoulder Flexion

Hold the triangle with the hand of the involved side. Hold the hook with the hand of the uninvolved side. The uninvolved arm pushes the exercise bar forward and up, moving the involved arm in the same direction.

Figure 4:
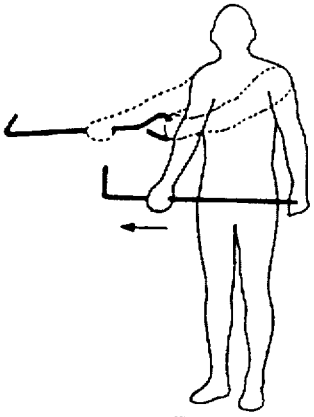

FIG. 4: Shoulder Abduction

The hand of the involved side holds the triangle. The hand of the uninvolved side grasps the bar, palm down. The arm of the involved shoulder is pulled up and across, remaining close to the body.

Figure 5A:
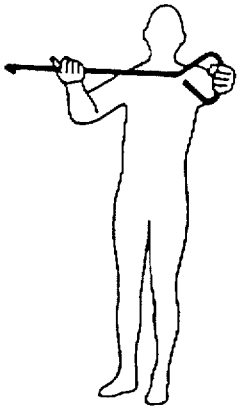
Figure 5B:
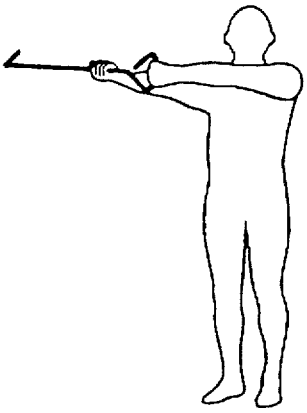

FIG. 5: Horizontal Abduction

The hand of the involved side holds the triangle straight out from the body. The hand of the uninvolved side grasps the bar palm up. (FIG. 5(*a*)). The arm of the involved side is pulled straight across with an attempt to keep the elbow straight. (FIG. 5(*b*)).

Figure 6:
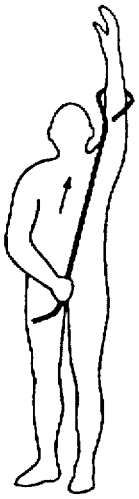

FIG. 6: Assisted Shoulder Flexion—Shoulder Flexion—Modified

Insert the arm of the involved side through the triangle as shown. The hand of the uninvolved side grasps the bar and pushes up and back.

Figure 7:
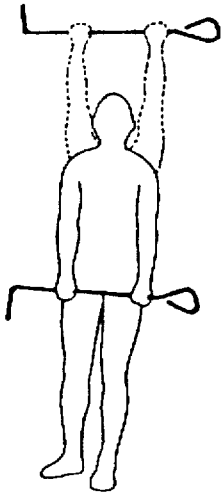

FIG. 7: Bilateral Shoulder Flexion

Grasp the exercise bar with both hands, palm down. Lift the exercise bar forward and up until both arms are above the head.

Figure 8:
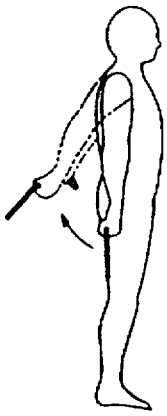

FIG. 8: Bilateral Shoulder Extension

Grasp the exercise bar behind the back, with both hands on either side of the body. The palms are facing back. Lift backward and upward without bending the elbows.

Figure 9:
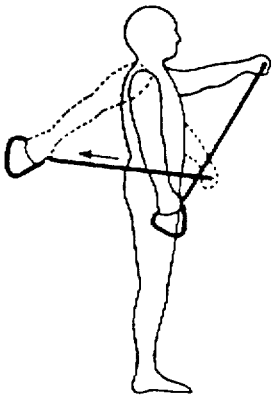

FIG. 9: Shoulder Extension (one arm)

Hold the triangle with the hand of the involved side, as shown. Use the hand of the uninvolved side to hold the hook, pushing down and back.

Figure 10A:
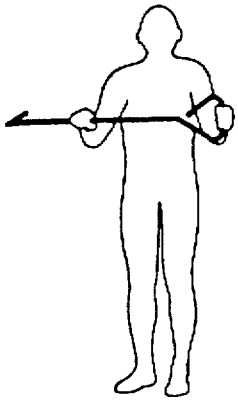
Figure 10B:
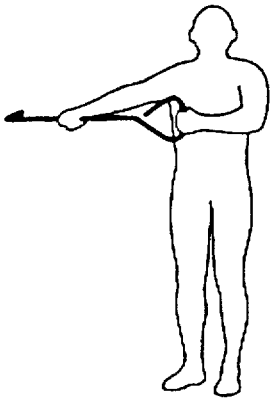

FIG. 10: Shoulder Internal Rotation—Neutral Position 0°

Use the hand of the involved side to hold the triangle. Bend the elbow of the involved side at a right angle, resting it against the side of the body. (FIG. 10(*a*)). With the hand of the uninvolved side, grasp the bar (FIG. 10(*a*)) and pull the hand holding the triangle across the body while the involved arm rotates in, remaining at the side. (FIG. 10(*b*))

Figure 11:
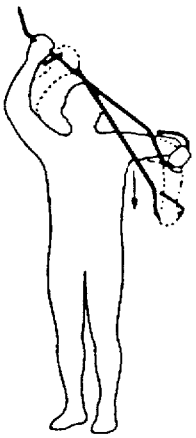

FIG. 11: Shoulder Internal Rotation @90° Abduction

Use the hand of the involved side to hold the and the elbow bent at a right angle. Grasp the bar with the hand of the uninvolved side and push the arm of the involved side, rotating it down. Maintain the right angle at the elbow. The forearm is rotated down from this position.

Figure 12:
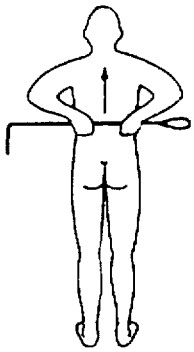

FIG. 12: Bilateral Shoulder Internal Rotation—Bilateral Elbow Flexion

Grasp the exercise bar with both hands behind the body as shown. Raise the bar toward the head.

Figure 13:
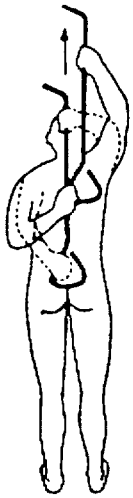

FIG. 13: Shoulder Internal Rotation—Abduction; Behind the Back Elbow Flexion With the hand of the involved side, hold the triangle behind the back.

With the hand of the uninvolved side, grasp the bar and pull straight up.

Figure 14:
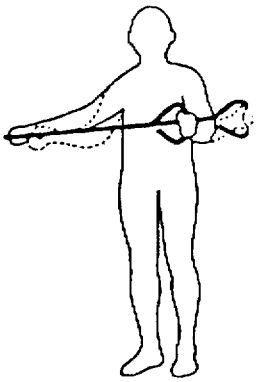

FIG. 14: Shoulder External Rotation—Neutral Position 0°

Hold the triangle with the hand of the involved side. Bend the elbow at a right angle and keep it close to the body. With the hand of the uninvolved side grasp the hook. Use the hand on the hook to push toward the involved side, rotating the arm of the involved side outward, while keeping the elbow close to the body.

Figure 15:
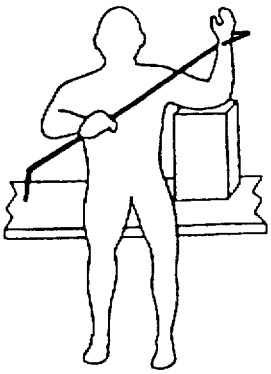

FIG. 15: Shoulder External Rotation—W/ Loss of Grip on Involved Side

Insert the hand of the involved side through the triangle. Bend the elbow of the involved side at a right angle. Prop as needed. Grasp the bar with the hand of the uninvolved side and push into the forearm of the involved side, causing it to rotate backward.

Figure 16:
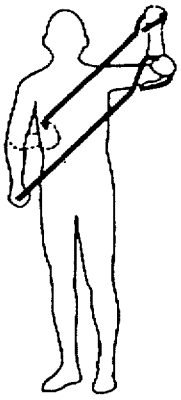

FIG. 16: Shoulder External Rotation—90° Abduction

Hold the triangle with the arm of the involved side, bending the elbow at a right angle as shown. Grasp the hook with the hand of the uninvolved side and push the hook up toward the involved side. This rotates the shoulder of the involved side back without changing the right angle bend of the elbow of the involved side.

Figure 17A:
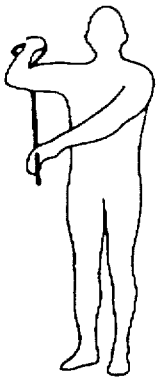
Figure 17B:
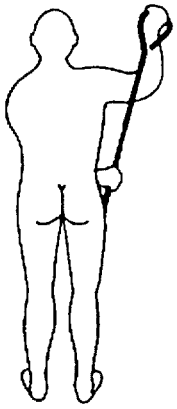
Figure 17C:
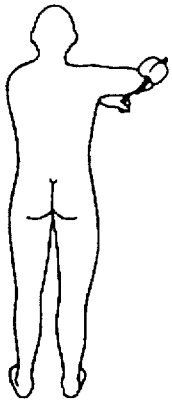

FIG. 17: Shoulder External Rotation—90° Abduction—Aplin Maneuver

With the hand of the involved side, hold the triangular handle with the exercise bar draped behind the arm. (FIG. 17(*a*)) Bend the elbow at a right angle with the fist pointing upward. The shaft of the bar will contact the back of the arm. With the hand of the uninvolved side, grasp the shaft from the front. (FIG. 17(*b*)) Bring the shaft upward, using the back of the arm as a pivot point. The arm and shoulder will rotate backwards. Then bring the shaft upward, using the contact point on the arm as a fulcrum. The arm and the shoulder are rotated backward. (FIG. 17(*c*))

Figure 18A:
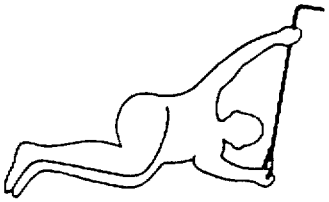
Figure 18B:
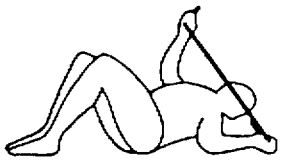

FIG. 18: Shoulder External Rotation—Jacob Maneuver

Lie on the involved side. Rest the arm of the involved side on the floor with the elbow bent at a right angle. Grasp the triangle with the hand of the involved side. Grasp the shaft with the hand of the uninvolved side. (FIG. 18(*a*)) Keep the arm of the involved side on the floor and slowly rotate the body away from the involved side. The hand of the uninvolved side exerts pressure down through the triangle to keep the arm of the involved side from moving while the body rolls away. (FIG. 18(*b*))

Figure 19:
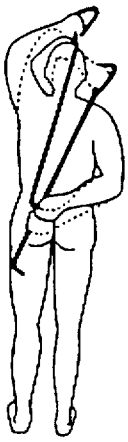

FIG. 19: Shoulder External Rotation—Abduction

With the hand of the involved side, grasp the triangle behind the head.

With the hand of the uninvolved side, grasp the hook as shown. Pull the hook down, bringing the arm of the involved side further behind the head. (FIG. 19*a*)

Figure 20A:
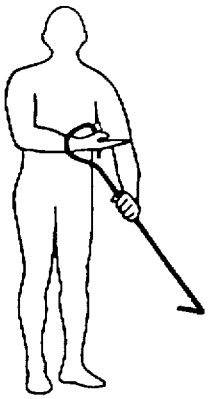
Figure 20B:
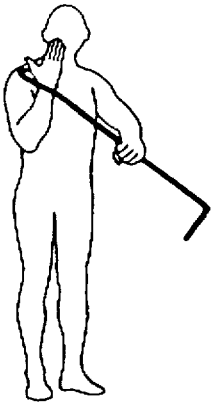

FIG. 20: Elbow Flexion

Insert the hand of the involved side through the triangle, palm up. (FIG. 20(*a*)) Grasp the shaft with the hand of the uninvolved side and push upwards, pressing against the forearm, bending the elbow and bringing the hand of the involved side toward the shoulder. (FIG. 20(*b*))

Figures 21A, 21B:
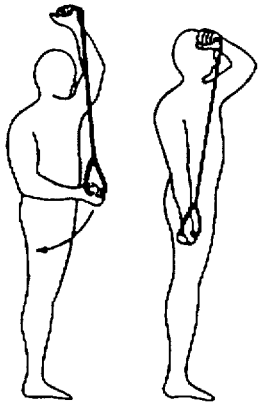

FIG. 21: Elbow Extension

Hold the triangle with the hand of the involved side. Hold the hook with the hand of the uninvolved side, pushing downward to straighten out the elbow. (FIGS. 21(*a*) and 21(*b*))

Figure 22:
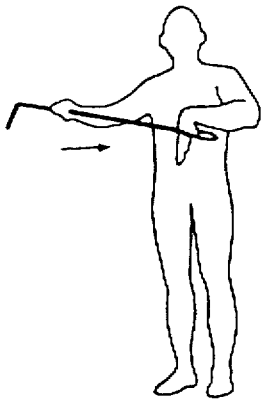

FIG. 22: Wrist Flexion

Insert the involved hand half-way through the triangle in a "limp wrist" position as shown. Grasp the shaft with the hand of the uninvolved side and apply pressure to the back of the hand of the involved side.

Figure 23:
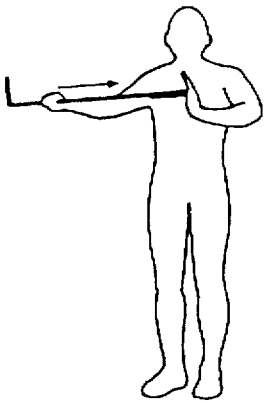

FIG. 23: Wrist Extension

Put the edge of the triangle against the palm of the hand as shown. Grasp the shaft with the hand of the uninvolved side and push against the hand of the involved side, bending it back.

Figure 24A:
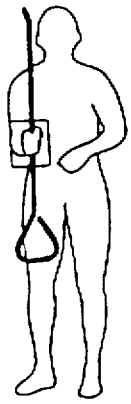
Figure 24B:
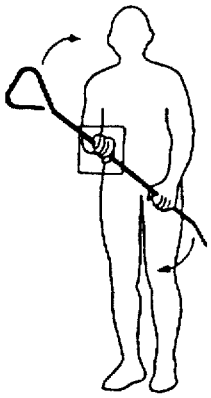
Figure 24C:
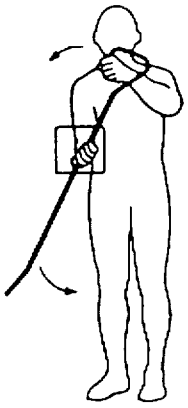

FIG. 24: Forearm Pronation/Supination

Grasp the exercise bar shaft with the hand of the involved side, bending the elbow at a right angle (neutral—FIG. 24(*a*)). With the hand of the uninvolved side, grasp the shaft and apply pressure to turn the palm down (pronation—FIG. 24(*b*)) or pressure to turn the palm up (supination—FIG. 24)*c*)).

FIG. 25: Wrist Ulnar/Radial Deviation

Figure 25A:
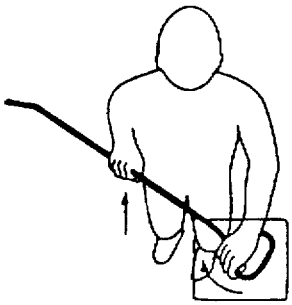
Figure 25B:
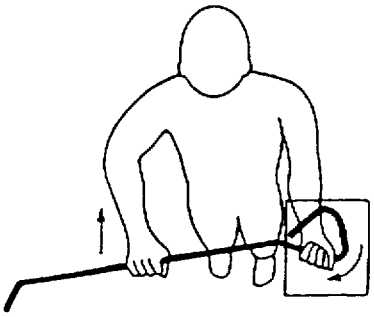

Hold the triangle with the hand of the involved side: palm down for Radial Deviation—as shown in FIG. 25*a;* palm up for Ulnar Deviation—as shown in FIG. 25*b*. Grasp the bar with the hand of the uninvolved side, pulling the bar toward the body, bending the wrist inward.

Figure 26:
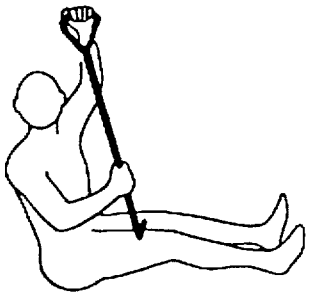

FIG. 26: Knee Extension (seated)

Place the hook several inches above the involved knee as shown. Hold the shaft with the hand of the uninvolved side. Grasp the triangle with the hand of the involved side and apply pressure downward, pushing the back of the knee into the floor.

Figure 27:
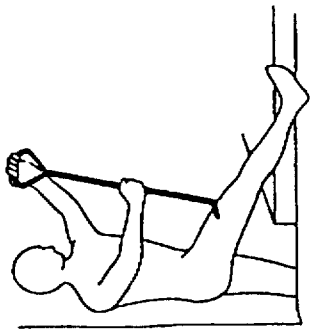

FIG. 27: Knee Extension (lying)

Place hook several inches above involved knee as shown. Hold shaft with hand of involved side. Grasp triangle with hand of uninvolved side and apply pressure downward into thigh towards wall.

Figure 28:
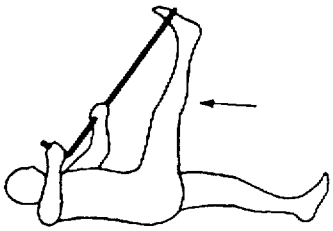

FIG. 28: Hip Flexion—Hamstring Stretch

Place the forefoot of the involved side into the triangle. Hold the hook with the hand of the involved side, while grasping the shaft with the hand of the uninvolved side. Pull the exercise bar toward the head, raising the leg. (FIG. 31*a*)

Figure 29:
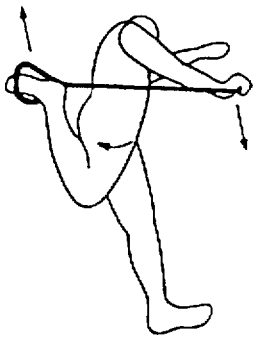

FIG. 29: Hip Extension—Knee Flexion—Ankle Plantar Flexion (lying)

Lie on the uninvolved side. Place the foot of the involved side through the triangle as shown. (FIG. 32*a*). Bend the knee of the involved side. Use the hand of the involved side to grasp the hook and push down. As the exercise bar pivots on the hip, the heel of the involved side is brought toward the buttocks. (FIG. 32*b*)

Figure 30:
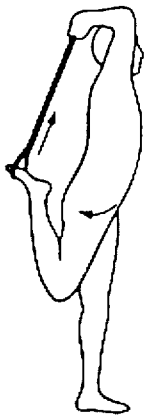

FIG. 30: Hip Extension—Knee Flexion—Ankle Plantar Flexion (standing)

Place the foot of the involved side through the triangle as shown (FIG. 33*a*). Use the hand of the involved side to grasp the hook behind the head and pull upward, bringing the heel of the involved side toward the buttocks. (FIG. 33*b*).

Figure 31:
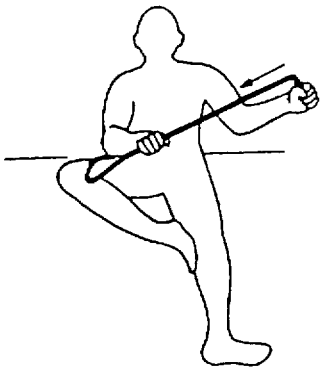

FIG. 31: Hip External Rotation—Abduction (sitting)

While sitting on the floor, rest the sole of the foot of the involved side against the leg of the uninvolved side. Apply the edge of the triangle to the thigh of the involved side. Use the hand of the uninvolved side to hold the hook just above (not on) the knee. Direct pressure into the thigh, rotating the thigh outward and pushing the knee toward the floor.

Figure 32:
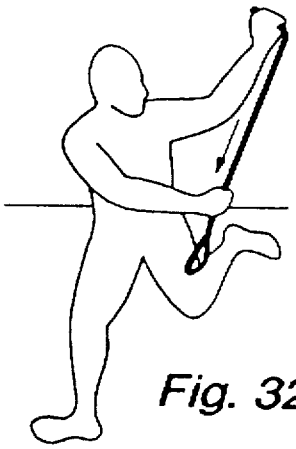

FIG. 32: Hip Internal Rotation (sitting)

While sitting on the floor, apply the edge of the triangle against the thigh of the involved side, as shown. Place the inside of the foot of the involved side against the floor. Use the hand of the uninvolved side to grasp the shaft near the triangle. Grasp the hook with the hand of the involved side. Apply pressure down to the thigh, turning it further inward towards the floor.

Figure 33:
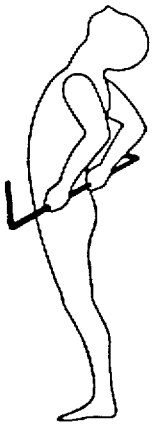

FIG. 33: Low Back Extension

Place the exercise bar across the low back, with hands grasping it on both sides of the body. Push the shaft into the body while leaning backward over it.

Figure 34:
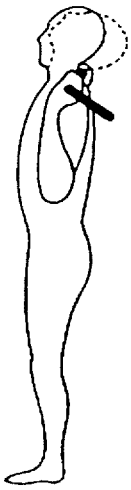

FIG. 34: Cervical Retraction and Extension

Place the exercise bar across the back of the neck just above the shoulders. Tuck the chin all the way in. Using the exercise bar as a fulcrum, tilt the head all the way back.

Figure 35A:
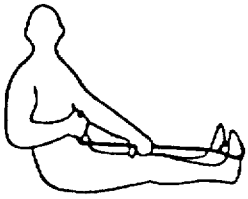
Figure 35B:
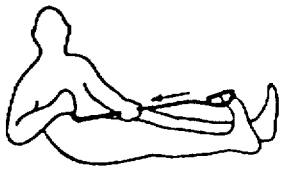

FIG. 35: Ankle and Mid-Tarsal Dorsi Flexion (seated)

Put the foot of the involved side through the triangle as shown (neutral position—FIG. 35(*a*)), placing the triangle slightly below the ball of the foot. Grasp the hook with the hand of the involved side and grasp the shaft with the hand of the uninvolved side. Pull the foot toward you. (Dorsi Flexion—FIG. 35(*b*))

Figure 36A:
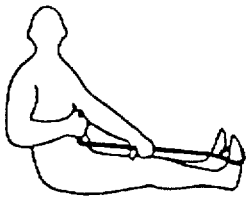
Figure 36B:
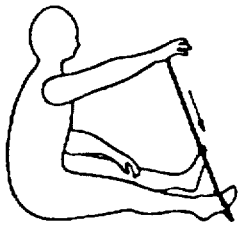

FIG. 36: Ankle and Mid-Tarsal Plantar Flexion (seated)

Place the foot of the involved side through the triangle as shown (neutral position—FIG. 36(*a*)). Grasp the hook with the hand of the involved side and push the exercise bar down into the foot, bending the ankle away from you. (Plantar Flexion—FIG. 36(*b*))

Figure 37A:
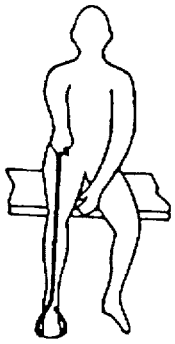
Figure 37B:
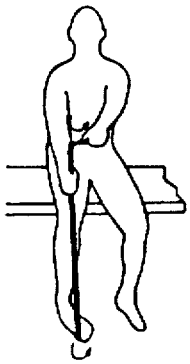

FIG. 37: Ankle Inversion (seated)

Place the foot of the involved side through the triangle as shown. (FIG. 37(*a*)). Hold the shaft with the hand of the involved side. The hook points away from you and is grasped by the hand of the uninvolved side which rotates the hook toward the body, bringing the foot forward the same direction. (FIG. 37(*b*)).

Motion occurs at the foot and ankle only. Do not permit movement at the knee.

Figure 38A:
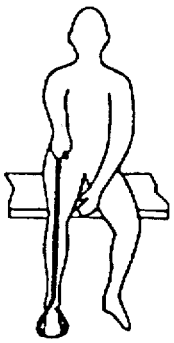
Figure 38B:
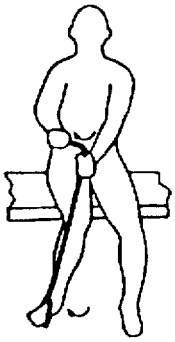

FIG. 38: Ankle Eversion (seated)

Place the foot of the involved side through the triangle as shown. (FIG. 38(*a*)). Hold the shaft with the hand of the involved side. The hook points away from you and is grasped by the hand of the uninvolved side which rotates the hook outward, turning the bottom of the foot outward. (FIG. 38(*b*)) Do not permit movement at the knee.

It is noted that the above-described exercises are only exemplary of the numerous type of exercises that can be performed with the exercise bar of the present invention. Additionally, although the present invention has been described in terms of the preferred embodiments, it will be appreciated that various modifications and alterations might be made by those skilled in the art without departing from the spirit and scope of the invention. The invention should, therefore, be measured in terms of the claims which follow.

We claim:

1. An exercise device for use in rehabilitative therapy of an impaired limb of a user, the device essentially consisting of:

an elongated shaft having a longitudinal axis, two ends and a straight section spanning between both ends; wherein a first end of the shaft is bent into a loop thereby, defining a plane encompassing the loop and the longitudinal axis of the shaft;

wherein a second end of the shaft is bent at an angle substantially perpendicular to the plane defined by the loop so as to form a handle; and wherein the loop is sized and configured to permit the impaired limb of the user to be inserted within and retained by the loop while an unimparied limb holds onto the second end to exercise the impaired limb.

2. The device of claim 1, wherein the loop defines a planar area which is bisected by the longitudinal axis of the shaft.

3. The device of claim 1, wherein the loop comprises a triangular shape having three arcuate angles for receiving and retaining a limb of the user upon insertion of the limb within the loop.

4. The device of claim 3, wherein the loop comprises an isosceles triangle having a vertex coupled to the second end of the shaft and a linear base disposed opposite to the vertex of the loop.

* * * * *